73-151
11/23/82 OR 4,359,900
SR

United States Patent [19]

Garney

[11] 4,359,900

[45] Nov. 23, 1982

[54] APPARATUS FOR MOUNTING A SENSING DEVICE IN A WELL LOGGING INSTRUMENT

[75] Inventor: Tom A. Garney, Houston, Tex.

[73] Assignee: Dresser Industries, Inc., Dallas, Tex.

[21] Appl. No.: 256,287

[22] Filed: Apr. 23, 1981

[51] Int. Cl.[3] ..... E21B 47/00

[52] U.S. Cl. ..... 73/151

[58] Field of Search ..... 73/151, 152, 712, 714; 367/25, 81; 250/256

[56] References Cited

U.S. PATENT DOCUMENTS 3,939,705 2/1976 Glotin et al. ..... 73/151

4,120,198 10/1978 Tanguy et al. ..... 73/151

*Primary Examiner*—Jerry W. Myracle

*Attorney, Agent, or Firm*—Richard M. Byron

[57] ABSTRACT

An elongated housing of a well logging instrument having a lever latch and positioning mechanism attached to a carriage and a snorkel and barrel assembly. One end of the sensing device is mounted on the carriage and the snorkel is affixed to the opposite end. The latch and positioning mechanism allows the assembly to be moved until the snorkel enters the barrel and retains it in place. The mechanism is then secured in place. The mechanism contains an indicator which is visible if the mechanism is not in position to be secured. Electrical signals are passed from the sensing device, through the snorkel to an electrical connector at the end of the barrel and through a cable to the earth's surface.

6 Claims, 3 Drawing Figures

APPARATUS FOR MOUNTING A SENSING DEVICE IN A WELL LOGGING INSTRUMENT

BACKGROUND OF THE INVENTION

This invention relates generally to apparatus to support a sensing device in a well logging tool and more specifically an apparatus to support a pressure-sensing device in a well logging tool.

In the development of oil and gas and other similar wells it is often necessary or desirable to detect the pressure in the borehole at all depths. This type of measurement is accomplished by lowering a pressure-sensing device into the well in a logging tool or instrument. The device communicates electrical signals representative of the downhole pressure to the surface via the logging instrument support cable. This pressure sensing device is supported in a housing both for physical protection and to provide some means to transfer the electrical signals from the device to the cable. These pressure-sensing devices are quite delicate to physical shock and abuse, thus they must be removed from the logging tool after each use. When these pressure-sensing devices are removed from a logging tool they are cleaned and they are transported in a protective case.

Apparatus for supporting these devices have been in use in the industry for many years. These apparatus typically require the pressure-sensing device to be joined to the housing by bolts immediately prior to their use. These apparatus are not only subject to deterioration from exposure to the well environment, but assembly and disassembly became time consuming and difficult. Thus, merely assembling the logging instrument for use can damage the pressure-sensing devices, thus possibly rendering them inoperable or requiring repair prior to use.

Accordingly, the present invention overcomes the deficiencies of the prior art by presenting a simple mechanical apparatus allowing for the simple installation and removal of a sensing device in a well-logging tool with a minimum possibility for damaging it.

SUMMARY OF THE INVENTION

An apparatus to retain a sensing device in a well logging tool, having an elongated housing and a locking and positioning mechanism coupled with a snorkel and barrel assembly designed to allow ease of removal of the sensing device from the housing. The housing has a longitudinal opening to allow for interface between the sensing device and the well environment and to facilitate removal of the device from the housing after use.

The first end of the sensing device is mounted on a carriage which is slidably retained by the housing. The second end of the device is fitted with a snorkel which is slidable within a barrel portion of the housing. The latch and positioning mechanism allows the carriage and sensing device to be moved until the snorkel enters and occupies the barrel. The mechanism is then latched in place, thereby retaining the second end of the sensing device within the housing. The latch and positioning mechanism includes a visual indicator to indicate if the mechanism is not latched and thus not ready for use in the well. The snorkel contains a means for passing electrical signals from the sensing device to an electrical connector at the end of the barrel. These electrical signals are then conducted to a cablehead at the upper end of the logging tool, and over a cable to electrical apparatus at the earth's surface.

One object of this invention is to provide a pressure-sensing device mounting structure that overcomes the aforementioned disadvantages of the prior art mounting devices.

Still, one other object of this invention is to provide a sensing device mounting structure that allows for easy mounting and removal of the sensing devices in a well logging instrument so they can be mounted for use and removed for cleaning, storage, and transportation.

Various other objects, advantages and features of this invention will become apparent to those skilled in the art from the following discussion, taken in conjunction with the accompanying drawings, in which:

Figure 1:
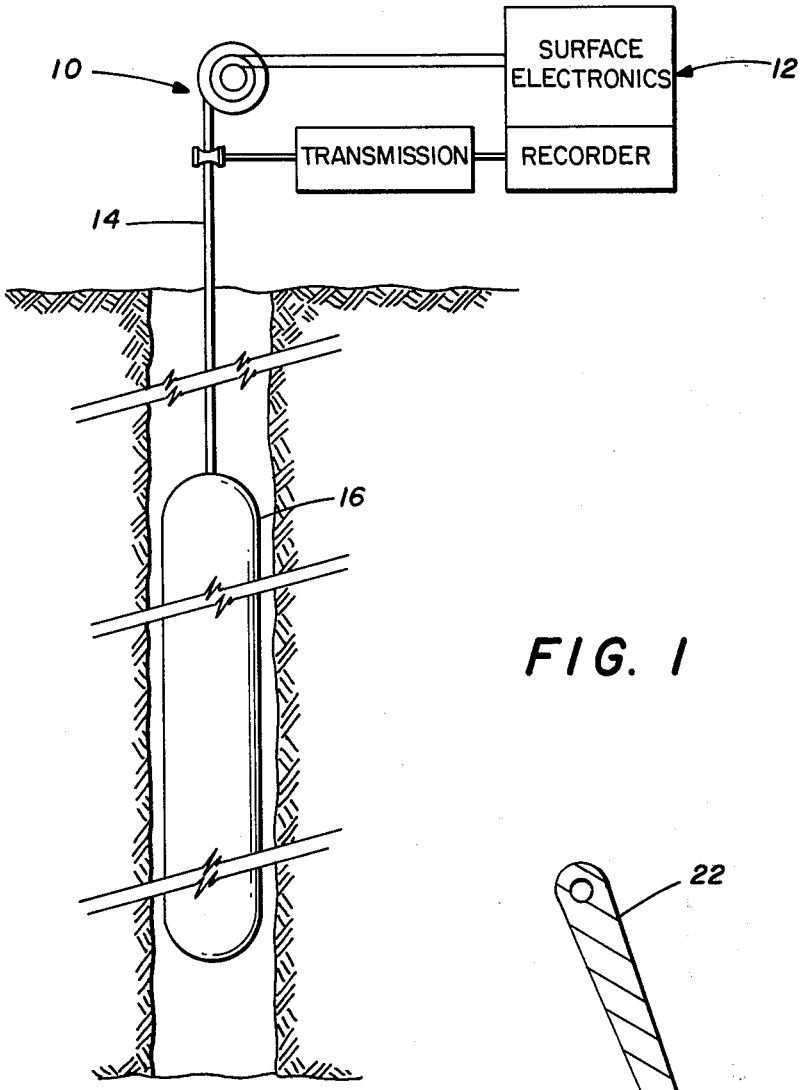
FIG. 1 is a schematic pictorial representation of a well or earth borehole being logged with a logging instrument therein and associated equipment at the earth's surface including a hoist and associated surface electronics for the logging instrument.

The following is a discussion and description of preferred specific embodiments of the mounting apparatus of this invention, such being made with reference to the drawings, whereupon the same reference numerals are used to indicate the same or similar parts of the structure. It is to be understood that such description is not to unduly limit the scope of the invention.

DETAILED DESCRIPTION OF THE DRAWINGS

Referring to FIG. 1 of the drawings in more detail, there is illustrated a well penetrating a portion of the earth, shown in vertical section. At the earth's surface is the operating equipment shown schematically and including a hoist 10 and the assorted electrical apparatus 12. In the well is an elongated logging instrument 16 containing the pressure-sensing device or pressure sensor 20. A cable 14 extends from the hoist at the earths surface and provides electrical connection between the surface electronics and apparatus 12 and the pressure-sensing device as well as providing physical support for the apparatus within the well.

Figure 2:
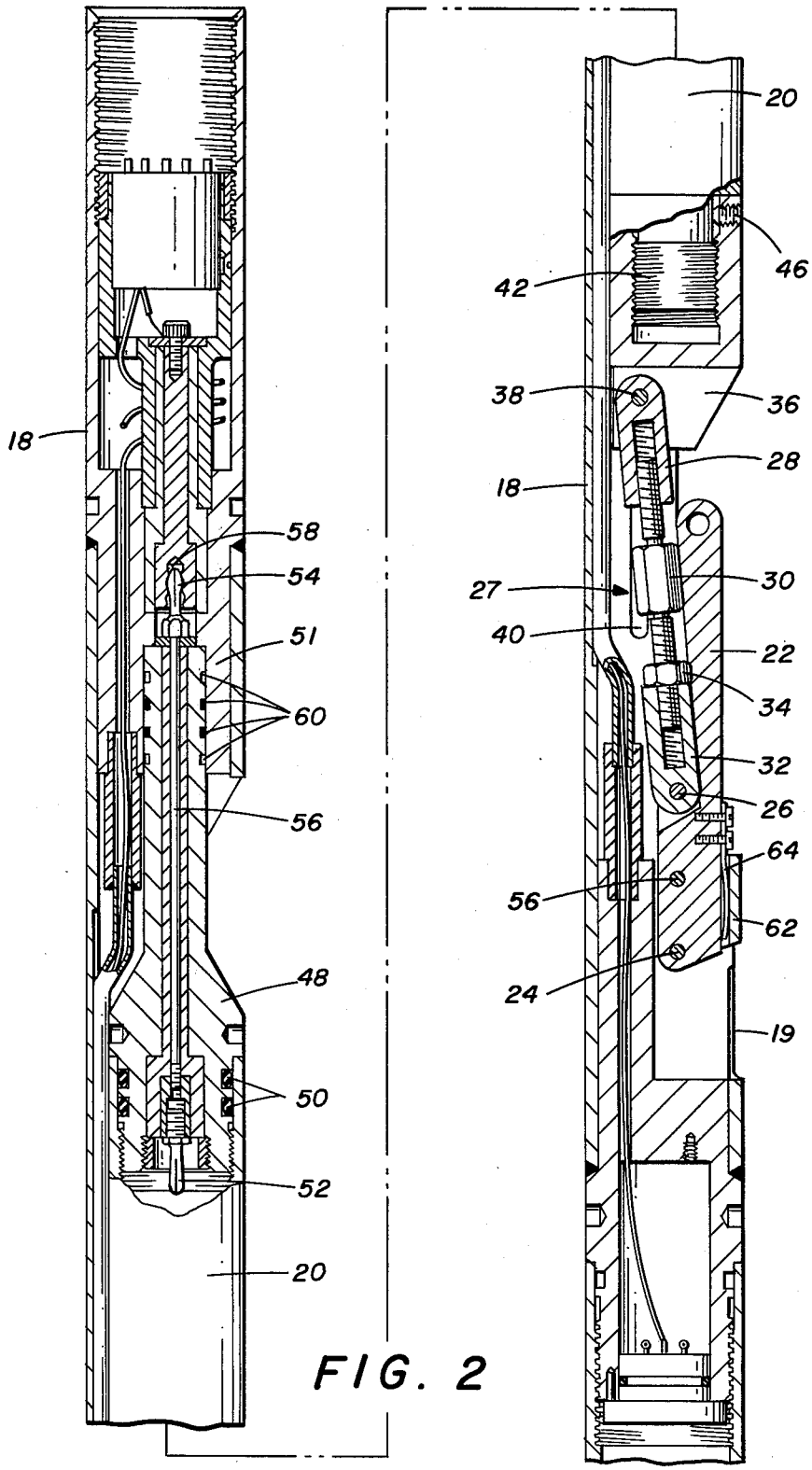
FIG. 2 is a cutaway elevation view of a portion of a well logging instrument having the mounting apparatus of this invention with the pressure-sensing device secured in place for use.

Referring to FIG. 2 of the drawings, the apparatus shown therein is representative of one configuration of the sensing device retainer or sideloader apparatus of this invention. The sensing device retainer contains an elongated housing 18 with a longitudinal cross section removed forming an opening 19 to allow interface between the pressure-sensing device and the well environment. The retainer apparatus further contains a mechanism for mounting pressure-sensing device 20 in housing 18.

Located near the distal end of the housing is a lever 22 which pivots around pivot pin 14. Attached to lever 22 by means of another pivot pin 26 is a turnbuckle-like adjustable linkage indicated generally at 27 and comprised essentially of an upper end piece 28, an adjusting piece 30, a lower end piece 32 and a locking nut 34. The purpose of this adjustable linkage is later described in the discussion of initial adjustment of the retainer apparatus. Lower end piece 32 of this linkage contains an internally threaded portion and a yoke by which it is attached to lever 22 by means of pivot pin 26 as described above. Threaded into lower end-piece 32 is adjusting piece 30 which is similarly threaded into upper end-piece 28. Threaded onto adjusting piece 30 is locking nut 34. Upper end-piece 28 contains one or more flanges which mate with complimentary flanges on a carriage 36 and are attached thereto by means of pivot pin 38. Carriage 36 is slidable within housing 18, being retained by pivot pin 38 which is slidable in a pair of elongated slots 40 or grooves in opposing side portions of housing 18.

As lever 22 is rotated away from housing 18 it acts upon adjustable linkage 27, which in turn acts upon carriage 36, drawing it towards the distal end of housing 18. Carriage 36 may be rotated around pivot pin 38 until its' internally threaded portion is positioned to be accessable through housing opening 19. The first or lower end 42 of pressure sensor 20 is threadably joined to carriage 36 until the mating surfaces contact. This contact is then secured by set screw 46.

The second or upper end portion of pressure-sensor 20 is threadably joined to snorkel 48. The non-threaded mating surface of snorkel 48 contains one or more o-ring grooves containing o-rings 50 to form a fluid-tight seal between the pressure sensor and the snorkel. Snorkel 48 contains an electrical cable for conducting electrical signals from pressure sensor 20. The embodiment shown here consists of two insulated electrical connectors 52 and 54, one at each end of snorkel 48 joined by insulated electrically conductive wire 56.

The carriage 36 and attached pressure sensor 20 with snorkel 48 are pivoted around pivot pin 38 until they lie against and parallel to housing 18. As lever 22 is rotated back to its original position it acts upon adjustable linkage 27, which acts upon carriage 36, sliding it toward the proximal end of housing 18. The upper portion of snorkel 48 is slidable within barrel 51, enters barrel 51 and moves within it until lever 22 is returned to its' original position, whereupon lever 22 is secured in place with locking pin 56. Upper barrel electrical connector 54 makes contact with mating connector 58 which is electrically joined to cable 14. The mating exterior surface of snorkel 48 has one or more grooves fitted with o-rings 60 to provide a fluid-tight seal when snorkel 48 has been introduced into receptacle barrel 51.

As the invention is operated in the well, electrical signals from pressure-sensing device 20 are transmitted to lower barrel connector 52, through the conductive connections described above to a cablehead at the top portion of logging instrument 16 and over cable 14 to the control and complimentary display and/or recording apparatus at the earth's surface.

Figure 3:
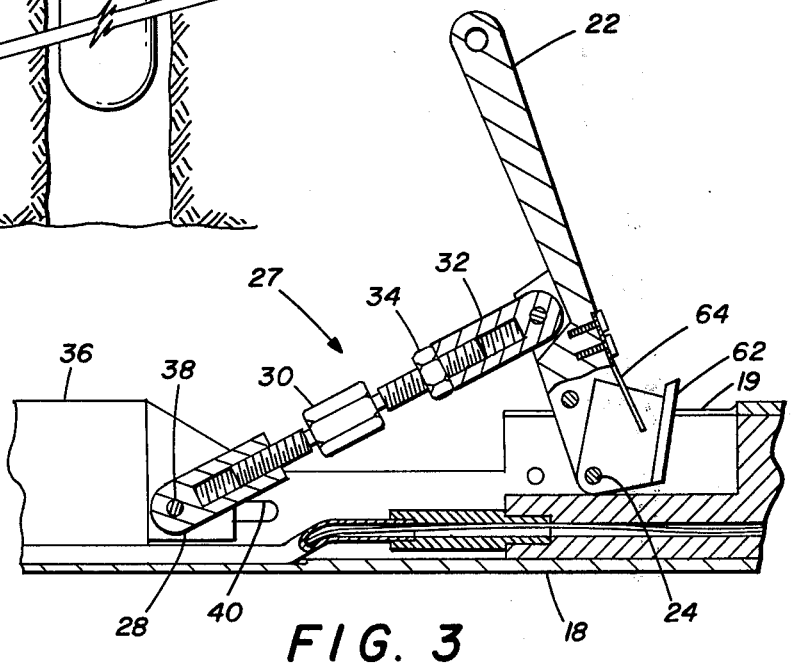
FIG. 3 is a cutaway elevation view of a portion of the latching mechanism shown in FIG. 2 with the latching mechanism positioned for removal of the pressure-sensing device.

FIG. 3 shows adjustable linkage 27 and associated portions of the adjacient structure with lever 22 in a raised position. This is the position assumed by the linkage 27 and carriage 36 when pressure-sensor 20 is either being inserted into or removed from the logging instrument. In the following description, reference can be made to FIG. 3 for understanding of operation of this mechanism.

The initial fitting of pressure-sensing device 20 to the sensing device retainer apparatus is done by way of adjustable linkage 27, with lever 22 rotated away from housing 18 through opening 19 and snorkel 48 thus retracted from barrel 51. Adjusting piece 30 is rotated until the threads extend the linkage to its maximum extension. Lever 22 is then activated to thrust snorkel 48 into barrel 51. The opposing mating surfaces of barrel 51 and snorkel 48 should contact before lever 22 reaches a fully closed position. Adjusting piece 30 is rotated, in a reverse manner from above, shortening the linkage until lever 22 may be fully closed and secured with locking pin 56.

Before the tool is used in the well the locking and positioning mechanism must be secured against the housing. The retainer apparatus also has an indicator to indicate whether or not this has been done and the tool is ready for operation. One such embodiment of an indicator is shown in FIG. 2 consisting of a warning flag 62 designed to visibly extend from the housing 18 when not secured by locking pin 56. Flag 62 pivots upon the same axis as lever 22 and is secured by locking pin 56 being inserted in consecutive complimentary holes in lever 22, flag 62, and housing 18. If locking pin 56 is not in place, securing lever 22 and flag 62, in a retracted position, spring 64 acts upon flag 62 causing it to rotate around pivot pin 24 and protrude perpendicularly from opening 19 in housing 18.

To assemble the tool for use in the well, lever 22 is rotated away from housing 18 then acting upon adjustable linkage 27 and carriage 36, drawing them toward the distal end of housing 18. Carriage 36 is rotated around pivot pin 38 until its threaded surface faces away from housing 18. The pressure-sensing device 20 is then threadably connected to the carriage 36 and secured in place by tightening set screw 46. This carriage 36 and attached pressure-sensor 20 with snorkel 48 is then rotated back against and parallel to housing 18. Lever 22 is then rotated back against housing 18 causing the unit to move toward the proximal end of the tool. As a result of this movement, snorkel 48 will enter barrel 51 and move within it until lever 22 is returned to a closed position. Indicator flag 62 is manually closed against the housing and, along with lever 22, is secured in place by locking pin 56. Disassembly of the tool after use is the exact reversal of the above procedure.

Many modifications and variations besides those specifically mentioned may be made in the techniques and structures described herein and depicted in the accompanying drawings without departing substantially from the concept of the present invention. For example, the described configuration of the adjustable linkage yoke end fitting could be replaced with fittings of a ball and socket type design or provisions could be made for multiple electrical contacts at the top of the snorkel coupled with a means for properly orienting the same. Accordingly, the forms of the invention described and illustrated herein are exemplary only and are not intended as limitations on the scope of the present invention.

The embodiments of the invention in which an exclusive property or privilege is claimed are defined as follows:

1. In a well logging system having a logging instrument containing a removable sensing device, a means to pass said logging instrument through an earth borehole, and electronic apparatus in said logging instrument and at the earth's surface to operate and monitor said sensing device, an improvement, comprising:

(a) a carriage means longitudinally movable mounted in said logging instrument and removably mountable with one end portion of said sensing device;

(b) a latch and positioning mechanism mounted to said logging instrument and operably connected to said carriage means to displace same between a secured position permitting use of said logging instrument and a released position permitting removal of said sensing device; and (c) connection means operably removably mountable with said sensing device and operably mountable with an electrical connector means in said logging instrument; and (d) mount means in said logging instrument adapted to removably mount in a fixed position another end portion of said sensing device.

2. An apparatus to mount a pressure-sensing device in a logging tool in a well, comprising:

(a) an elongated housing with a longitudinal opening;

(b) a latch and positioning mechanism mounted on the housing;

(c) a carriage moved by the latch and positioning mechanism and providing mounting and support for a first end of the pressure-sensing device and allowing such first end to be disconnected from said latch and positioning mechanism;

(d) a snorkel attached to a second end of the pressure-sensing device containing a means for transferring electrical signals generated in the pressure-sensing device;

(e) a barrel portion of said housing into which said snorkel is mountable, providing a securing means for said second end of said pressure-sensing device and containing a means for picking up the electrical signals from the snorkel and transmitting them to an electrical circuit means in said logging tool; and (f) a contact block which receives the electrical signals from said barrel portion and provides a means by which the signals may be conducted to a logging cable connectable to said logging tool.

3. The mount apparatus of claim 2, wherein said latch and positioning mechanism comprises:

(a) a lever pivotally mounted to said housing;

(b) a longitudinally adjustable lengthwise linkage attached between said lever and said carriage including two threaded end-pieces, threadably joined to a complimentary threaded adjusting piece and a means for locking the end pieces and adjusting piece in relative position to one another; and (c) a locking pin to secure said lever in a retracted position within said housing.

4. The latch and positioning mechanism of claim 3, comprising:

a visual indicator means indicative of said latch and positioning mechanism being in condition for being secured in place to said housing which is visible unless said latch and positioning mechanism is secured in a retracted position against said housing.

5. The mount apparatus of claim 2, wherein said snorkel comprises;

a first end threadably mountable with said pressure-sensing device and containing an electrical connector conductively joined to another electrical connector on the second end of said snorkel for passing electrical signals from the pressure-sensing device through said snorkel.

6. An apparatus to mount a pressure-sensing device in a logging tool in a well, comprising:

(a) an elongated housing with a longitudinal opening in a mid-portion thereof;

(b) a lever pivotally mounted in said housing;

(c) a linkage means attached to and movable by said lever;

(d) a carriage attached to and moved by said linkage means including a threaded portion adapted to mount the first end of a pressure-sensing device;

(e) means for slidably retaining said carriage within said housing;

(f) a snorkel attached to the second end of the pressure-sensing device and containing an electrical connector at each end electrically conductively joined;

(g) a barrel having an opening therein into which said snorkel is slidably mountable including an electrical connector complimentary with said electrical connector at the upper end of said snorkel whereby the two connectors will mate when said snorkel is fully inserted into said barrel;

(h) an electrical contact block within said housing which is electrically coupled to said barrel contained electrical connector whereby electrical signals from the pressure-sensing device may be communicated to other apparatus for said logging instrument within said housing.

* * * * *